US005742104A

United States Patent [19]

Eriksson et al.

[11] Patent Number: 5,742,104

[45] Date of Patent: Apr. 21, 1998

[54] MAIN OPERATED ELECTRIC FENCE ENERGIZER

[75] Inventors: Lars-Arne Eriksson, Sundsvall; Göran Karl-Olov Karlsson, Enhörna, both of Sweden

[73] Assignee: Alfa Laval Agri AB, Tumba, Sweden

[21] Appl. No.: 663,110

[22] PCT Filed: Dec. 29, 1994

[86] PCT No.: PCT/SE94/01269

§ 371 Date: Aug. 22, 1996

§ 102(e) Date: Aug. 22, 1996

[87] PCT Pub. No.: WO95/18520

PCT Pub. Date: Jul. 6, 1995

[30] Foreign Application Priority Data

Dec. 29, 1993 [SE] Sweden ..... 9304343

[51] Int. Cl.[6] ..... G08B 13/26

[52] U.S. Cl. ..... 307/108; 361/232; 256/10

[58] Field of Search ..... 307/106–108, 307/132 R; 361/232; 256/10; 340/564; 324/678, 713

[56] References Cited

U.S. PATENT DOCUMENTS

| | | |
|---|---|---|
| 3,051,449 | 8/1962 | Legrand . |
| 3,205,378 | 9/1965 | Kline . |
| 3,332,001 | 7/1967 | Schwarz . |
| 3,378,694 | 4/1968 | Griffeth . |
| 3,397,344 | 8/1968 | Skirpan . |
| 3,448,361 | 6/1969 | Dinter . |
| 3,525,878 | 8/1970 | Houlne . |
| 3,566,149 | 2/1971 | Paradissis . |
| 3,590,279 | 6/1971 | Thompson . |

(List continued on next page.)

FOREIGN PATENT DOCUMENTS

| | | |
|---|---|---|
| 1395498 | 5/1975 | European Pat. Off. . |
| 2847993 | 5/1980 | Germany . |
| 3904993 | 8/1980 | Germany . |
| 0036089 | 2/1981 | Germany . |
| 0179435 | 4/1986 | Germany . |
| 4140628 | 6/1993 | Germany . |
| 216748 | 4/1986 | New Zealand . |
| 219542 | 3/1987 | New Zealand . |

OTHER PUBLICATIONS

SEMKO Certificate issued Apr. 15, 1987.

*Primary Examiner*—Richard T. Elms

*Attorney, Agent, or Firm*—Hovey,Williams,Timmons & Collins

[57] ABSTRACT

An electric fence energizer is operated by an alternating current and has two storage capacitors ($C_1$, $C_2$), which are charged by a charging circuit (7) to a high voltage. The storage capacitors ($C_1$, $C_2$) are discharged through separate primary windings ($L_1$, $L_2$) in a transformer (T) and the secondary winding ($L_3$) of the transformer is connected to the electric fence. The discharging processes are controlled by separate discharging circuits ($R_1$, $T_{y1}$; $T_{y3}$ and $T_{y3}$ respectively), so that for light loads only one of the storage capacitors ($C_1$) is discharged, and for heavy loads also the other one ($C_2$) is discharged starting a short time after the start of the discharging of the first one and during the same discharge cycle. Sense circuits ($L_2$, $R_8$, $R_9$, $C_3$, $R_{10}$, $R_{11}$, $R_{12}$, $T_4$, $R_{13}$) provide signals PCHL; PPUL) to a microprocessor (7) and they represent the load on the transformer (T). One of the sense circuits ($L_2$, $R_8$, $R_9$, $C_3$) comprises the second primary winding ($L_2$) and is used for measuring light loads. It controls, whether the second storage capacitor $C_2$ is to be charged and can in certain cases control the charge voltage. The second sense circuit ($R_{10}$, $R_{11}$, $R_{12}$, $T_4$, $R_{13}$) is connected to one terminal of the storage capacitors ($C_1$, $C_2$) and is used for measuring heavy loads. It controls the time for a start of the discharging of the second storage capacitor and can also in certain cases control the charge voltage. In that way the supplied pulses will have a high voltage and a large energy content and a good safety is achieved.

15 Claims, 1 Drawing Sheet

U.S. PATENT DOCUMENTS

| | | | |
|---|---|---|---|
| 3,654,489 | 4/1972 | Knapton | 307/107 |
| 3,655,994 | 4/1972 | Malme | 256/10 |
| 3,655,995 | 4/1972 | Malme | 256/10 |
| 3,743,924 | 7/1973 | Genuit et al. . | |
| 3,772,601 | 11/1973 | Smith | 307/106 |
| 3,928,809 | 12/1975 | Tschudi et al. . | |
| 4,087,705 | 5/1978 | Barnes . | |
| 4,090,140 | 5/1978 | Carter . | |
| 4,099,128 | 7/1978 | Hooper . | |
| 4,150,307 | 4/1979 | Loucks . | |
| 4,158,785 | 6/1979 | Desaintfuscien . | |
| 4,160,214 | 7/1979 | Colin et al. . | |
| 4,274,033 | 6/1981 | Nuckolls . | |
| 4,322,817 | 3/1982 | Kuster . | |
| 4,329,595 | 5/1982 | Watson | 307/107 |
| 4,394,583 | 7/1983 | Standing | 307/108 |
| 4,396,879 | 8/1983 | Weinreich et al. | 256/10 |
| 4,456,835 | 6/1984 | Pichler et al. | 307/107 |
| 4,859,868 | 8/1989 | McKissack | 307/106 |
| 5,550,530 | 8/1996 | Hamm | 256/10 |
| 5,596,281 | 1/1997 | Eriksson | 340/564 |

MAIN OPERATED ELECTRIC FENCE ENERGIZER

BACKGROUND OF THE INVENTION

1. Field of the Invention

The present invention relates to an electric fence energizer of the discharge type, i.e. comprising a capacitor, which is charged to a high voltage and is discharged to the primary winding of a transformer, the secondary winding of the transformer providing a very high voltage to the electric fence circuit. The energizer is in particular intended to be operated by the mains supply, that is by the alternating voltage from the public electric energy distribution network.

2. Description of the Prior Art

Various requirements from the authorities restrict the electric voltage pulses which are allowed to be supplied to an electric fence. The conventional requirements in Western Europe are thus that the maximum voltage in each pulse is at most 10 kV over the output terminals of the electric fence energizer, the largest electric current per pulse through a human being or through an animal is allowed to be 10 A, each electric pulse is not allowed to carry more energy than 5 joules, which can be provided to a human being or an animal contacting the electric fence, the pulses are not allowed to come more frequently than one pulse per second and the length of each pulse should be smaller than 1.5 ms and finally that the total amount of charge in each pulse, which can be provided to a human being or an animal contacting the fencing network, should be less than 2.5 millicoulombs. Naturally, all these requirements exist in order to reduce the risk for damages to human beings and animals which contact the electric fence network. However, in order that an electric fence should efficiently limit or deter animals, the pulses provided from the electric fence should both have as large voltage as possible and have as large energy as possible, within the limits imposed by the authorities.

An electric fence considered as an electric circuit, however, presents large variations depending on weather, earthing, and other factors which influence the isolation of the fence wire in relation to the earth or the ground. The resistance of the electric fence to ground can thus for dry weather and otherwise dry exterior conditions with good isolation be very large compared to the condition which can be obtained, when for instance a human being is in contact with the fence, when the resistance can decrease to about 500 ohms. For extreme exterior conditions, in addition, the resistance can decrease to still lower values. The electric fence circuit also comprises a capacitive part which can be important, when the resistance of the fence is large and which can cause that the circuit operates as a swinging circuit owing to the inductance in the transformer winding which supplies the high voltage pulses to the fence circuit. It can result in overswings in the voltage pulse generated on the fence side, which causes that the charge voltage for the capacitor, from which the pulse is discharged, must be reduced in order that the output pulses should not be too high. Then, without a suitable control, a reduced voltage will be obtained also in those cases, when the fence circuit only has an insignificant capacitive component compared to the fence resistance.

A possibility of obtaining an electric fence having a good efficiency is using two transformers, one of which is used for providing high voltage pulses, when the electric fence has a good isolation to earth, also included in this isolation one or several human beings or one or several animals in contact with the fence, and another is used in the case where this isolation is not as good, such as for humid weather. In the latter case, for circuit technical reasons, only smaller voltage pulses can be supplied but they will then instead be given a larger energy content. Alternatively a single transformer having two separate primary windings can be used.

In the British Patent Specification No. 1 395 498 an embodiment of an electric fence device is disclosed, see FIG. 1, having a second primary winding 4. The voltage over this extra winding is used for control of the discharge process.

In the published German patent application No. 41 40 628 an average value of a voltage pulse supplied to an electric fence is sensed and used for control of the charging of a storage capacitor. The average value is sense directly on the output side of the fence energizer, this arrangement being dangerous since high voltage may be applied to control circuits of the energizer.

In the published German patent application No. 39 04 993 an electric fence energizer is disclosed having separate primary windings of one or two transformers, these windings being associated with separately arranged energy storage capacitors and discharge circuits therefor. Both capacitors or only one thereof may be discharged depending on an average value of the peak voltage pulses supplied to the fence. The peak values of the voltage pulses are sensed on the fence side of the energizer, this obviously being hazardous or dangerous as stated above.

SUMMARY OF THE INVENTION

It is an object of the invention to provide an electric fence energizer which provides high voltage pulses having a large energy content and which has good security functions.

With the electric fence energizer according to the invention, the more detailed characteristics of which appear from the appended claims, this object is achieved.

There are thus sense circuits in the energizer, these circuits always sensing voltages or other characteristics on the primary side of the step-up transformer. No galvanic connections need to be made to the fence circuit on the secondary side.

The electric fence energizer is thus preferably operated by an alternating voltage, for instance from the public electric energy distribution network, and it has generally two separate storage capacitors, which are charged by a common charging circuit to a high voltage. The storage capacitors are discharged through separate primary windings in a transformer and the secondary winding of the transformer is in the conventional way connected to the electric fence. The discharge processes of the storage capacitors are controlled by separate discharging circuits, so that for light loads—a light load means a high resistance in the fence circuit to earth—only one of the storage capacitors is discharged, and for heavy loads—heavy loads are obtained for a small resistance in the fence circuit—also the other storage capacitor is discharged starting a short time after the start of the discharging of the first one and during the same discharge cycle. Sense circuits provide signals to the charging circuits and discharging circuits as processed and evaluated by a microprocessor and these signals represent in various cases the load on the transformer, that is from the fence circuit. One sense circuit comprises the second primary winding and is used for measurement of light loads. It can for very light loads, when the capacitance in the fence circuit can be important, reduce the voltage, to which the storage capacitors are charged. The other sense circuit is connected to a terminal of the storage capacitors and is used for a measurement of heavy loads. It controls, whether the second storage capacitor should be discharged at all during a discharge cycle and in that case the time of the start of the discharge of the second storage capacitor. It can, in short circuit cases with, a very low resistance in the fence circuit, also reduce the charge voltage for the storage capacitors. The discharge of the first storage capacitor is made, during a first short time period, through a circuit having a larger resistance than resistance which exists during the rest of the discharge.

Thus, there is generally an electric fence energizer which preferably is operated by an alternating voltage, in particular from the public electric energy distribution network. In the energizer there is a first storage capacitor and a charging circuit connected to the alternating voltage and the first storage capacitor for charging the storage capacitor to a high voltage. Further there is a first primary winding belonging to a transformer, a secondary winding of the transformer being connected to the electric fence and the primary winding being connected to the first storage capacitor. A discharge circuit is provided for the first storage capacitor and it is arranged to periodically discharge the first storage capacitor through its connected primary winding, for generating discharge pulses, which from the secondary winding of the transformer are supplied to a connected electric fence.

In a first aspect, there is a sense circuit for sensing the load on the transformer from a connected electric fence and for providing a signal representing the load, the sense circuit comprising a second separate primary winding of the transformer and a sense line connected to that winding. The sense circuit is arranged for sensing, during a discharge of the first storage capacitor, at a selected time, that is at a time controlled or set by a controlling device such as a microprocessor, the instantaneous magnitude of the voltage induced in the second primary winding, this sensed magnitude being a measure or representing the load on the transformer from a connected fencing network.

The sense circuit can be an extreme value sensing circuit connected to the second primary winding and it then senses a maximum of the absolute value of voltage pulses induced in the second primary winding during discharges of the first storage capacitor. When the sensing times are set by a controller, the absolute value may be sensed at varying times from the start of a discharge pulse. Thus the sense circuit can be arranged to sense, during successive discharges of the first storage capacitor, the instantaneous magnitude of the voltage induced in the second primary winding at times, which are selected, so that the time periods from the start of the discharge of the first capacitor to the sensing time have different lengths, and then these sensed magnitudes can be evaluated for a determination of a maximum of the absolute value of the voltage pulses induced in the second primary winding.

The charging circuit for the first capacitor can then be connected to the sense circuit for controlling the voltage, to which the first storage capacitor is charged by the charging circuit, depending on the value or values sensed by the sense circuit.

There may also be arranged a second storage capacitor, which also has a charging circuit connected to the alternating voltage and to the second capacitor for charging it to a high voltage, this charging circuit preferably being common to both storage capacitors. This second storage capacitor is then connected to the second primary winding of the transformer. There is also a discharging circuit for the second storage capacitor, which is arranged to discharge it through the secondary primary winding, for generating, in the same way as for the first storage capacitor and the first primary winding, discharge pulses, which are delivered by the secondary winding of the transformer to a connected electric fence.

The control device, generally a microprocessor, is connected to the sense circuit and to the discharging circuit for the second storage capacitor and it is arranged for deciding, depending on the signal from the sense circuit, whether the discharging of the second storage capacitor is or is not to be started, during each periodic discharge of the first capacitor, the discharge of the first capacitor always taking place periodically, at evenly distributed time intervals.

The control device may naturally also be connected to the discharging circuit for the first storage capacitor and is then arranged to always first start the discharging of the first storage capacitor and to start or not to start, at a time thereafter, while the discharging of the first storage capacitor is still in process, in parallel therewith, the discharging of the second storage capacitor depending on the signal from the sense circuit representing the load, which is sensed by the sense circuit during the time period from the start of the discharging of the first storage capacitor to the start of the discharging of the second capacitor, the sensing and the start of the discharge of the second capacitor always being made during the same discharge process or cycle for the first storage capacitor.

Thus generally, the sense circuit senses the load on the transformer from the fence and provides a signal representing the load and therefor it comprises an extreme value sensing circuit for sensing the maximum of the absolute value of a voltage pulse, which is obtained at a discharging of the first storage capacitor. It provides a signal representing the sensed maximum to the charging circuit for the first storage capacitor and this charging circuit is arranged to control a voltage, to which the first storage capacitor is charged thereby, depending on the signal representing the maximum sensed by the sense circuit.

In another aspect, the sense circuit comprises a conductive line connected to a first terminal of the first storage capacitor and there is in the energizer a discriminating circuit connected to this conductor for sensing the time, at which, during a discharging cycle or process of the first storage capacitor, the voltage over the first storage capacitor has decreased to a predetermined value.

The sense circuit may then comprise a transistor, the base of which, through a voltage divider or potentiometer circuit, is connected to a first terminal of the first storage capacitor, the second terminal or electrode of the capacitor being connected to ground.

The charging circuit for the first storage capacitor may then be arranged to reduce a voltage, to which the first storage capacitor is charged by the charging circuit, when the sense circuit senses a very heavy load, in particular a short circuit, in an electric fence connected to the transformer.

In this aspect, also a second storage capacitor may be arranged having a charging circuit connected to the alternating voltage for charging the second storage capacitor to a high voltage. A second primary winding which is different from the first primary winding, belongs to a transformer, which preferably is the same as the transformer associated with the first primary winding and the first storage capacitor, and a secondary winding of the transformer is connected to the electric fence and the second primary winding is connected to the second storage capacitor. There is a discharging circuit for the second storage capacitor, which is arranged to discharge it through the second primary winding, for generating, in the same way as for the first storage capacitor and the first primary winding, discharge pulses, which are delivered by the secondary winding of the transformer to a connected electric fence.

The discharging circuit for the first storage capacitor at each discharge period can then be arranged to first start the discharging of the first storage capacitor and the discharging circuit for the second storage capacitor is arranged to then start, during this discharging process or cycle of the first storage capacitor, at a time depending on the load sensed by the sense circuit, the discharging of the second storage capacitor.

In still another aspect, there are first and second storage capacitors and charging circuits connected to the alternating voltage and to the first and the second storage capacitor respectively for charging the first and the second storage capacitor respectively to a high voltage, the charging circuits preferably being the same circuit used for the two capacitors. There are separate, first and second primary windings belonging to transformers, generally the same one, and secondary windings of the transformers are connected to the fence. The first and second primary windings are then as above connected to the first and the second capacitor respectively. Discharging circuits for the first and second storage capacitor are arranged to periodically discharge the first and the second storage capacitor respectively through its associated primary winding, for generating discharge pulses, which from the secondary winding of the respective transformer are supplied to a connected electric fence.

A sense circuit is as above arranged for sensing the load on the transformers from a connected electric fence and for providing a signal representing the sensed load. The discharging circuit for the first storage capacitor is arranged, at each discharge period, to first start the discharging of the first storage capacitor and the discharging circuit for the second storage capacitor is arranged to start, during this discharging, at a time depending on the load sensed by the sense circuit, the discharging of the second storage capacitor.

BRIEF DESCRIPTION OF THE DRAWING

An embodiment of the invention will now be described with reference to the accompanying drawing, in which.

DETAILED DESCRIPTION OF THE PREFERRED EMBODIMENT

Figure 1:
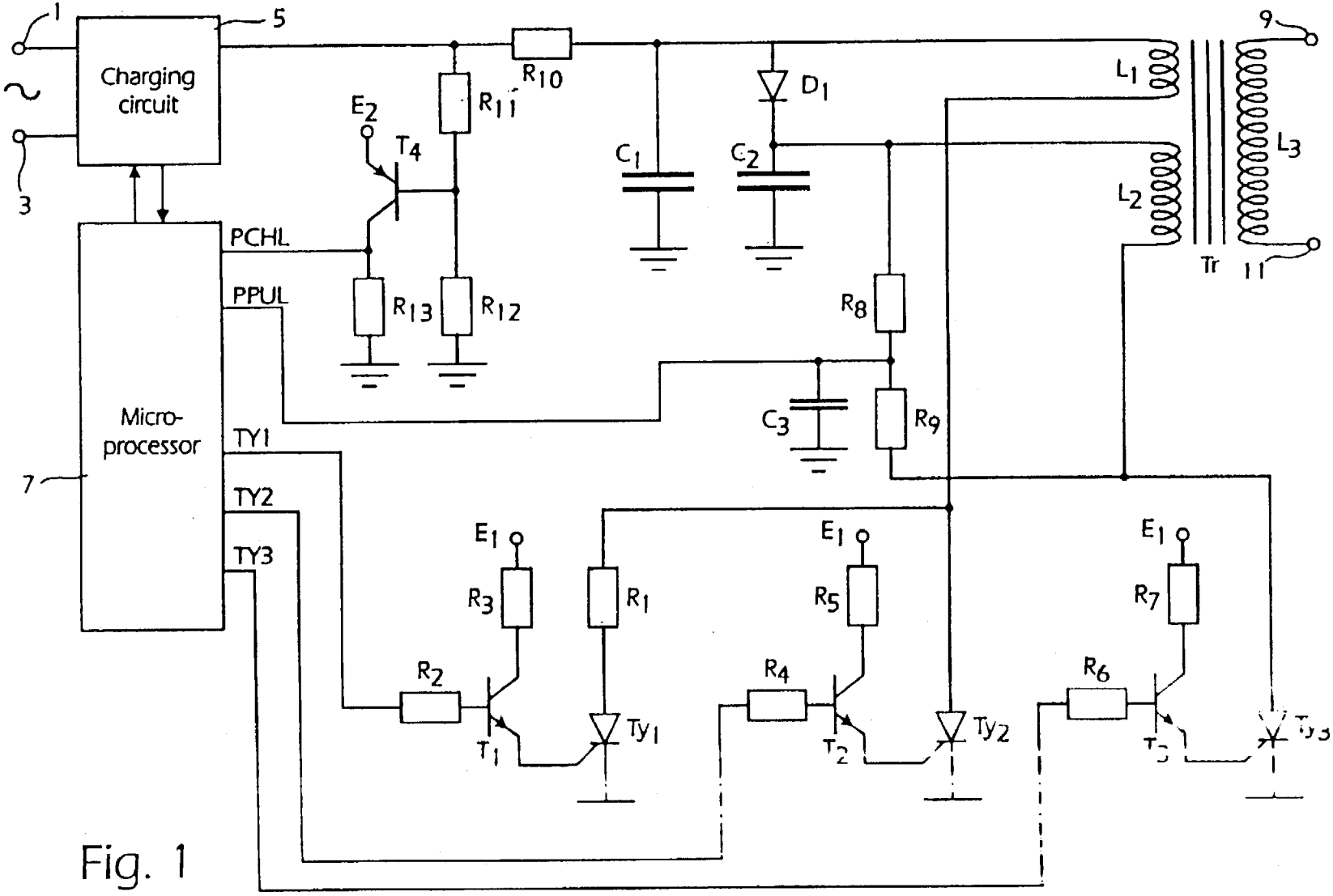
FIG. 1 shows a circuit diagram of a mains operated electric fence energizer.

An electric circuit for an electric fence energizer is in its essential parts shown by the circuit diagram of FIG. 1. An alternating voltage, e.g. from the public electric energy distribution network, is supplied between terminals 1 and 3 to a charging circuit 5. A microprocessor 7 controls the charging circuit 5 for charging two, equally large storage capacitors $C_1$ and $C_2$, which have a large capacitance and are connected in parallel with their first terminals or plates to the charging circuit 5, and thus are charged by the charging circuit 5 to the same voltage, the charge voltage. The charge voltage is maximally about 630 V but can be given, by the microprocessor 7 when required, a lower value. The two storage capacitors $C_1$ and $C_2$ have both their second terminals or plates connected to electronics or signal ground and the first terminals are each one connected to a separate primary winding $L_1$ and $L_2$ respectively of a transformer T, which is provided with a single secondary winding $L_3$. The secondary winding $L_3$ supplies high voltage pulses to the fence circuit, not shown, which is connected between terminals 9 and 11 of the secondary winding. The fence circuit is described in more detail in our simultaneously filed International application PCT/SE94/01268 filed Dec. 29, 1994 having the title "Defective earth testing for an electric fence energizer", which is incorporated herein by reference.

The other end of the first primary winding $L_1$ is through a resistor $R_1$ connected to the positive terminal or electrode of a first thyristor $Ty_1$, the negative electrode of which is connected to electronics ground. The electronic circuits have a made-up or artificial ground connection, which has a potential corresponding to either one of the poles of the supplied mains voltage, i.e. equal to the potential of a phase, the ground or the neutral conductor. The gate electrode of the thyristor $Ty_1$ is controlled by means of a signal TY1 from the microprocessor 7, which is provided through a resistor $R_2$ to the base of a transistor $T_1$, the emitter of which is connected to the gate electrode of the first thyristor $Ty_1$. The collector of the transistor $T_1$ is through a collector resistor $R_3$ connected to a positive supply voltage $E_1$ of e.g. 12 V, this supply voltage being a constant voltage in relation to signal ground. The first primary winding $L_1$ of the transformer T is in parallel herewith connected to the positive electrode of a second thyristor $Ty_2$, but without any resistor in the connection line. The negative electrode of the thyristor $Ty_1$ is connected to the electronics ground. This thyristor $Ty_2$ is controlled in a similar way as the thyristor $Ty_2$ by means of a signal TY2 from the microprocessor 7, which is delivered through a base resistor $R_4$ to the base of a transistor $T_2$, the emitter of which is directly connected to the gate electrode of the thyristor. The collector of the transistor $T_2$ is through a resistor $R_5$ connected to the positive supply voltage $E_1$.

Also the second primary winding $L_2$ of the transformer T has its second terminal connected to the positive electrode of a thyristor, a third thyristor $Ty_3$, and the negative electrode of this thyristor $Ty_3$ is also connected to electronics ground like the two other thyristors $Ty_1$ and $Ty_2$. Also this third thyristor $Ty_3$ is controlled in the corresponding way by a signal TY3 from the microprocessor 7, which through a base resistor $R_6$ is delivered to the base of a transistor $T_3$, the emitter of which is connected to the gate electrode of the third thyristor $Ty_3$. The collector of the transistor $T_3$ is through a resistor $R_7$ connected to the positive supply voltage $E_1$.

The load in the shape of the fence circuit connected to the secondary winding $L_3$ of the transformer T is evaluated or measured in two different ways. To be used for light loads and high output voltages a voltage divider circuit is arranged in the shape of resistors $R_8$ and $R_9$, which is connected between the terminals of the second primary winding $L_2$ of the transformer T. At the centre point of the voltage divider, between its resistors $R_8$ and $R_9$, a signal is drawn in the shape of a voltage which is delivered to an input port PPUL of the microprocessor 7. The centre point of the voltage divider is also through a capacitor $C_3$ connected to signal ground. The signal PPUL is a high positive voltage for the illustrated polarities, when the load from the fence circuit is heavy.

The measurement is performed more accurately in such a way that the microprocessor 7 at a selected time sets its input PPUL to the potential of the signal ground conductor, whereby the capacitor $C_3$ is completely discharged. Then the input port PPUL is displaced to a state having a high resistance, whereby the voltage supplied through the voltage divider $R_8$, $R_9$ charges the capacitor $C_3$. The voltage over this capacitor $C_3$ increases and finally achieves a voltage value corresponding to a logical high level on the input PPUL of the microprocessor 7. The length of the time period, which has elapsed during charging the capacitor $C_3$ to this level, is measured by the microprocessor 7 and forms a measure of the voltage over the second primary winding $L_2$. The capacitance of the capacitor $C_3$ is chosen to have such a small value that the whole measuring procedure is performed during a short time, during which the voltage over the second primary winding $L_2$ changes little.

A second evaluation of the load to be used, when the load is heavy (a small resistance in the fence circuit, i.e. between the terminals 9 and 11) and thus a low output voltage is delivered from the secondary winding of the transformer T, is given by a signal obtained on an input port PCHL of the microprocessor 7. The first terminals of the storage capacitors $C_1$ and $C_2$ are through a resistor $R_{10}$ connected to the charging circuit 5 and to this connection point between the charging circuit 5 and the resistor $R_{10}$ also the base of a transistor $T_4$ is connected through a voltage divider circuit comprising a resistor $R_{11}$ connected to the aforementioned point and a resistor $R_{12}$ which has its one terminal connected to signal ground. The charge voltage of the storage capacitor $C_1$ is caused to proportionally, by means of the voltage divider, drive this transistor $T_4$. The transistor $T_4$ is, different from the other transistors, of PNP-type and has its emitter connected to a positive stable and constant supply voltage $E_2$, e.g. the supply voltage of 5 V, which is conventionally used for driving the microprocessor 7, the constant level being taken in relation to the signal ground connection, and has its collector connected through a resistor $R_{12}$ to electronics ground. The measurement signal is delivered to the input port PCHL of the microprocessor from the collector of the transistor $T_4$.

The measurement process is also here, as described more accurately, a time measurement. The base of the transistor $T_4$ is, at the start of the discharge of the storage capacitors $C_1$, $C_2$, at a high potential and thus the current through the transistor $T_4$ is blocked. When the discharge process continues, however, the voltage over the voltage divider $R_{11}$, $R_{12}$ decreases to finally give a so low potential at the centre point of the voltage divider circuit, at the base of the transistor $T_4$, that the transistor $T_4$ starts to conduct. The potential at the collector of the transistor $T_4$ then increases from an initially low value to a value corresponding to a high logical level at the input ports of the microprocessor 7, which can correspond to 100 to 300 V over the primary windings $L_1$, $L_2$ of the transformer T. This time can then be sensed by the microprocessor 7 and the time length from the start of the discharging of the first storage capacitor $C_1$ to this time is then a measure of the resistive lead between the output terminals 9, 11 of the transformer T. The choice of the voltage, at which a transition occurs, i.e. when the transistor $T_4$ starts to conduct, is important in those cases where the fence lead has a significant capacitive component. If a too high change voltage is chosen—by selecting suitable magnitudes of e.g. the resisters $R_{10}$, $R_{11}$ and $R_{12}$—a lead having a capacitive part will result in a shorter time, before the transistor $T_4$ changes over, and thus be detected as a heavier lead. This measurement functions as long as the lead of the fence is so heavy that the capacitor has time to be discharged, before the iron core of the transformer T will be magnetically saturated.

The discharge of the storage capacitors $C_1$ and $C_2$ occurs principally in such a way that first the discharging of the storage capacitor $C_1$ is started through the first primary winding which is provided with a smaller number of winding turns than the second primary winding $L_2$. Hereby a high output voltage is induced having an order of magnitude of approximately those 10 kV which are allowed in the fence circuit. This is valid when the fence circuit is a small load on the transformer. After some discharging, more particularly after a certain controllable time period after the start of the discharging of this first storage capacitor $C_1$, the discharging can, if required, be started from the second storage capacitor $C_2$ over the second primary winding $L_1$, whereby the discharge pulse is reinforced and gains further energy. In order that the discharge current from the second capacitor then will not pass through the first primary winding $L_1$, the connection of the second storage capacitor $C_2$ is made through a diode $D_1$ to the charging circuit 5.

The load is determined by the microprocessor 7 and its value is evaluated by the microprocessor in order to decide whether at all the second storage capacitor $C_2$ is to be connected and in that case in order to determine a suitable time for the start of the discharge of the second storage capacitor $C_2$.

The discharge of the storage capacitors $C_1$ and $C_2$ is determined by means of the thyristors $Ty_1$, $Ty_2$ and $Ty_3$. These are, at the charging process of the storage capacitors $C_1$, $C_2$, blocked and are caused to conduct by means of the control signals TY1, TY2, and TY3 respectively, obtained from the microprocessor 7. In the discharging of the first storage capacitor $C_1$, which gives the high voltage on the secondary side of the transformer T, first the thyristor $Ty_1$ is ignited. Then the first storage capacitor $C_1$ is discharged through the first primary winding $L_1$ in series with the resistor $R_1$. This discharging will hereby be a little attenuated and reduces the tendency to overvoltages or overswings of the generated voltage on the secondary winding $L_3$ of the transformer T, which can occur, when the load in the shape of the fence circuit, connected between the terminals 9, 11, has a capacitive component. Then, after a small, predetermined time period the second thyristor $Ty_2$ is ignited by means of the signal TY2. At this time, when the voltage over the first storage capacitor $C_1$ has decreased a little, the discharge is made through the first primary winding $L_1$ directly through the thyristor $Ty_2$.

Finally, also the second storage capacitor $C_2$ can be caused to be discharged, by causing the thyristor $Ty_3$ to conduct as controlled by the signal TY3 and then the discharge of the second storage capacitor $C_2$ is made through the second primary winding $L_2$ directly through the thyristor $Ty_3$.

During that time period, when only the first storage capacitor $C_2$ is discharged, also a voltage is induced in the second primary winding $L_2$ and this signal is evaluated at different times by means of the signal, which is provided to the processor 7 on its input terminal PPUL.

During the discharge cycles, when also the second storage capacitor $C_2$ is discharged through the transformer T, it is performed, by means of this signal on the input terminal PPUL, an instantaneous measurement of the load between the terminals 9, 11, on the secondary side of the transformer T during exactly this discharge pulse from the first storage capacitor $C_1$ before the start of the discharge of the second capacitor $C_2$. The result of this measurement is used by the microprocessor 7 in order to control that the delivered voltage is not too high and thus that the load has not decreased or become lighter. If the voltage should be too high, the discharge of the second storage capacitor $C_2$ is not started at all.

The signal on the input PPUL of the microprocessor 7 is also used for providing an accurate measurement of the load for high output voltages and light loads. It can during longer time periods, when the discharge of the second storage capacitor $C_2$ does not need to be started owing to the light load, be evaluated during several successive discharge cycles for the first storage capacitor $C_1$. From this signal a value of the maximum voltage of the discharge pulse can be derived, i.e. generally the maximum of the absolute value. The discharge pulse will, as has been mentioned above, have different appearances depending on the load and among other things on the capacitive component thereof. The measurement of the maximum voltage is made in such a way, that the voltage of the discharge pulse is measured at different times, as considered from the start of the discharge, during successive discharge pulses. The largest value determined in that way is then the desired maximum value. When the determined maximum value is too high, the microprocessor 7 can control the charging circuit 5 for the storage capacitors $C_1$ and $C_2$ in such a way, that they instead of being charged to the normal 630 V instead are charged to for instance about 500 V. Hereby one can achieve that the energizer gives output pulses lower than the limit values of the authorities, but that at the same time output pulses are obtained having a voltage, which is as high as possible.

For heavy loads and thus small output voltages the microprocessor 7 uses the signal on the input terminal PCHL, which then gives an accurate determination of the load. Then normally also, the second storage capacitor $C_2$ is used to add more energy to the voltage pulse on the output side of the transformer T and the time for connecting the second storage capacitor is determined by the microprocessor 7 by means of the value determined from the signal on the input terminal PCHL.

The load is thus measured during each discharge cycle by means of the signal on the input terminal PCHL and in particular, the value determined from this signal is used for deciding whether heavy loads, for instance smaller than 20 ohms such as for a short circuit, exist in the fence circuit. In that case an overheating can occur in the device, in particular in the windings of the transformer T, and in that case the microprocessor 7 decides, in accordance with a control scheme or control program entered therein, that the charge voltage for the storage capacitors $C_1$ and $C_2$ is to be reduced to some suitable value.

We claim:

1. An electric fence energizer comprising:

a first storage capacitor:

a charging circuit connected to an alternating voltage and the first storage capacitor for charging the storage capacitor to a high voltage;

a transformer being subject to a load and having a first primary winding and a secondary winding, the primary winding being connected to the first storage capacitor and the secondary winding being connectable to an electric fence;

a discharge circuit for the first storage capacitor which is arranged to periodically discharge the first storage capacitor through its connected primary winding for generating discharge pulses supplied from the secondary winding of the transformer to a connected electric fence; and a sense circuit for sensing the load on the transformer from a connected electric fence and for providing a signal representing the load, the transformer having a second separate primary winding connected to the sense circuit via a sense line, the sense circuit including means for sensing the instantaneous magnitude of the voltage induced in the second primary winding at a selected time during a discharge of the first storage capacitor.

2. An electric fence energizer according to claim 1, wherein the second primary winding has more winding turns than the first primary winding.

3. An electric fence energizer according to claim 1, wherein the sense circuit includes an extreme value sensing circuit connected to the second primary winding for sensing a maximum of the absolute value of voltage pulses induced in the second primary winding during discharges of the first storage capacitor.

4. An electric fence energizer according to claim 3, wherein the sense circuit includes means for sensing, during successive discharges of the first storage capacitor, the instantaneous magnitude of the voltage induced in the second primary winding at times, which are selected, so that the time periods form the start of the discharge of the first capacitor to the sensing time have different lengths, and means for evaluating these sensed magnitudes for a determination of a maximum of the absolute value of the voltage pulses induced in the second primary winding.

5. An electric fence energizer according to claim 3, wherein the charging circuit for the first capacitor is connected to the sense circuit and includes means for controlling a voltage, to which the first storage capacitor is charged by the charging circuit, depending on the maximum sensed by the sense circuit.

6. An electric fence energizer according to claim 1, further comprising:

a second storage capacitor;

a charging circuit connected to the alternating voltage and the second storage capacitor for charging it to a high voltage, the second storage capacitor being connected to the second primary winding of the transformer; and a discharging circuit for the second storage capacitor for discharging the second storage capacitor through the second primary winding for generating, in the same way as the first storage capacitor and the first primary winding, discharge pulses which are delivered by the secondary winding of the transformer to a connected electric fence.

7. An electric fence energizer according to claim 6, further comprising a control device connected to the sense circuit and discharging circuit for the second storage capacitor for deciding whether the discharging of the second storage capacitor is or is not to be started during each periodic discharge of the first capacitor depending on the signal from the sense circuit.

8. An electric fence energizer according to claim 7, wherein the control device is also connected to the discharging circuit for the first storage capacitor and is arranged to always first start the discharging of the first storage capacitor and to start or not to start, at a time thereafter, while the discharging of the first storage capacitor is still in progress, in parallel the discharging of the second storage capacitor depending on the signal from the sense circuit representing the load which is sensed by the sense circuit during the time period from the start of the discharging of the first storage capacitor to the start of the discharging of the second capacitor.

9. An electric fence energizer according to claim 1, wherein the sense circuit includes an electric storage means charged by the induced voltage in the second primary winding.

10. An electric fence energizer according to claim 9, wherein the sense circuit comprises time measurement means for measuring the length of the time period for charging the storage means from the second primary winding.

11. An electric fence energizer comprising:

a first storage capacitor;

a charging circuit connected to an alternating voltage and the first storage capacitor for charging the storage capacitor to a high voltage;

a transformer having a first primary winding and a secondary winding, the primary winding being connected to the first storage capacitor and the secondary winding being connectable to an electric fence;

a discharging circuit for the first storage capacitor for periodically discharging the first storage capacitor through its connected primary winding for generating discharge pulses which are transferred from the secondary winding of the transformer to a connected electric fence; and a sense circuit for sensing the load on the transformer from a connected electric fence and for providing a signal representing the load, the sense circuit including an extreme value sensing circuit for sensing the maximum of the absolute value of a voltage pulse which is obtained at a discharging of the first storage capacitor, and for providing a signal representing the sensed maximum, the charging circuit for the first storage capacitor being connected to the sense circuit and being arranged to control a voltage to which the first storage capacitor is charged by the charging circuit pending on the signal representing the maximum sense by the sense circuit.

12. An electric fence energizer according to claim 11, wherein the sense circuit includes means for sensing, during successive dischargings of the first storage capacitor, the instantaneous magnitude of a voltage pulse which is obtained by discharging the first storage capacitor at selected times such that they occur at differently large time intervals from the start of the discharging of the first storage capacitor during each discharge cycle thereof, and for comparing and evaluating the sense magnitudes for determination of a maximum of the absolute value of the voltage pulses obtained in the dischargings of the first storage capacitor.

13. An electric fence comprising:

a first storage capacitor;

a charging circuit connecting to an alternating voltage and the first storage capacitor for charging the first storage capacitor to a high voltage;

a transformer having a first primary winding and a secondary winding, the first primary winding being connected to the first storage capacitor and the secondary winding being connectable to an electric fence;

a discharging circuit for the first storage capacitor including means for periodically discharging the first storage capacitor through the first primary winding of the transformer for generating discharged pulses which are supplied to a connected electric fence from the secondary winding of the transformer; and a sense circuit for sensing the load on the transformer from a connected electric fence and for providing a signal representing the sense load, the sense circuit including a conductive line connected to a first terminal of the first storage capacitor and a discriminating circuit connected to said conductive line for sensing the time at which the voltage across the first storage capacitor has decreased to a predetermined value during a discharge of the first storage capacitor and a transistor, the base of which is connected to the first terminal of the first storage capacitor through a voltage divider.

14. An electric fence energizer according to claim 13, wherein the charging circuit for the first storage capacitor includes means for reducing a voltage by which the first storage capacitor is charged by the charging circuit when the sense circuit senses a short circuit in an electric fence connected to a transformer.

15. An electric fence energizer according to claim 13, further comprising:

a second storage capacitor;

a charging circuit connected to the alternating voltage and the second storage capacitor for charging the second storage capacitor to a high voltage;

a second primary winding of the transformer which is different from the first primary winding and which is connected to the second storage capacitor; and a discharging circuit for the second storage capacitor for discharging said second storage capacitor through the second primary winding for generating, in the same way as for the first storage capacitor and the first primary winding, discharge pulses which are delivered by the secondary winding of the transformer to a connected electric fence, the discharging circuit for the first storage capacitor at each discharged period including means for first starting the discharge of the first storage capacitor, the discharging circuit for the second storage capacitor including means for then starting the discharge of the second storage capacitor during this discharge of the first storage capacitor at a time depending upon a load sensed by the sense circuit.

* * * * *